United States Patent [19]

Belokin et al.

[11] Patent Number: 4,738,028

[45] Date of Patent: Apr. 19, 1988

[54] PIZZA CUTTER

[76] Inventors: Martin P. Belokin; Norman P. Belokin, both of 7801 I-35N and Milam Rd., Denton, Tex. 76201

[21] Appl. No.: 931,622

[22] Filed: Nov. 17, 1986

[51] Int. Cl.[4] ..... B26B 3/00

[52] U.S. Cl. ..... 30/319; 30/337; 30/347; 403/298; 403/348

[58] Field of Search ..... 30/347, 388, 381, 312, 30/319, 337, 307; 403/360, 375, 383, 345, 348, 349, 298

[56] References Cited

U.S. PATENT DOCUMENTS

| | | | |
|---|---|---|---|
| 359,480 | 3/1887 | Weber . | |
| 1,200,284 | 10/1916 | Wheaton . | |
| 1,204,009 | 11/1976 | Goodwin . | |
| 1,465,075 | 8/1923 | Di Carlo | 30/307 |
| 1,487,226 | 3/1924 | Frahm . | |
| 2,089,881 | 8/1937 | Dohring | 30/307 |
| 3,346,956 | 10/1967 | Wezel et al. | 30/347 |
| 3,460,427 | 8/1969 | Baumgarten | 403/375 |
| 4,423,551 | 1/1984 | Chmela et al. | 30/142 |

*Primary Examiner*—Douglas D. Watts
*Attorney, Agent, or Firm*—Wood, Dalton, Phillips, Mason & Rowe

[57] ABSTRACT

According to the invention, a pizza cutting device is provided comprising an elongate handle, a cutting wheel with a peripheral cutting edge and a hub having a bore with a central axis and structure for removably assembling the handle with the cutting wheel so that the cutting wheel is guidingly rotatable relative to the handle about the hub central axis. The handle has spaced bearing surfaces which stabilize the device during use.

11 Claims, 1 Drawing Sheet

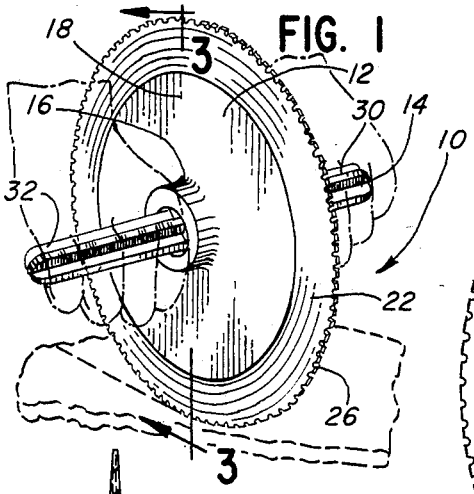
FIG. 1
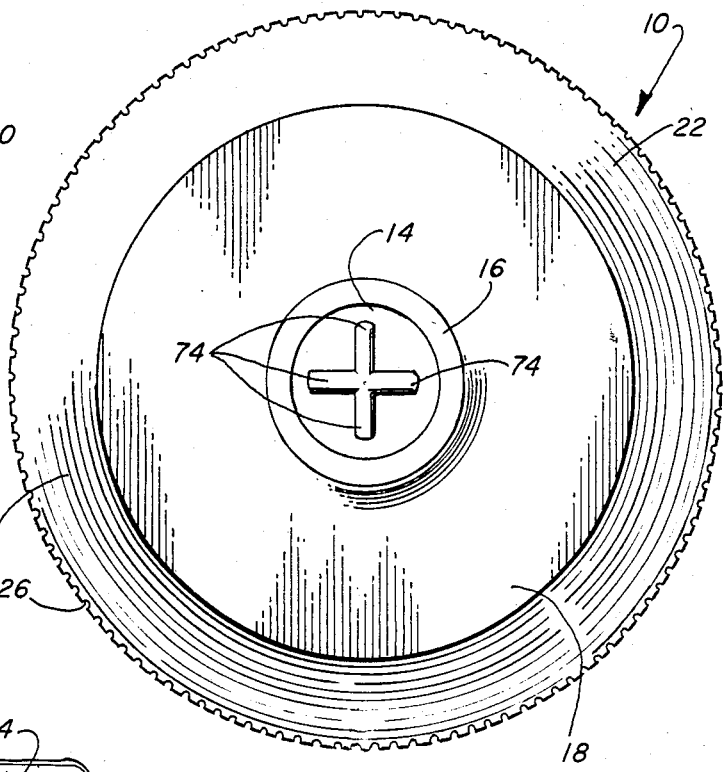
FIG. 2
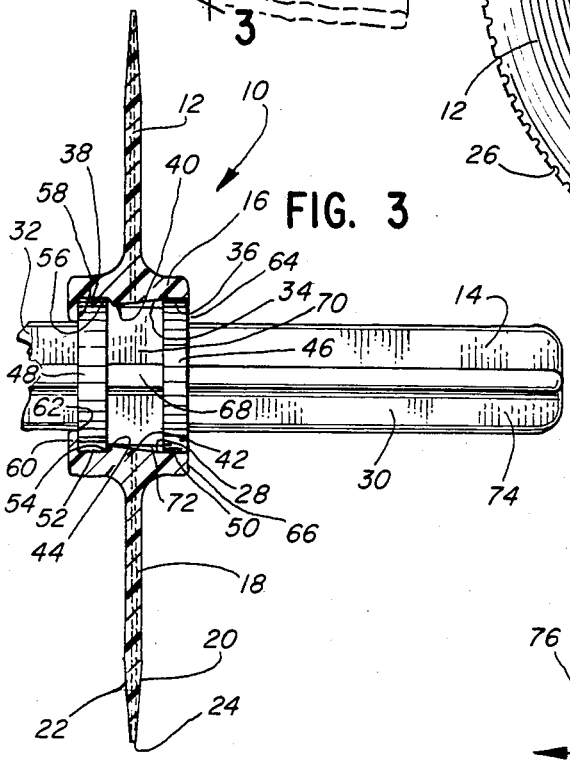
FIG. 3
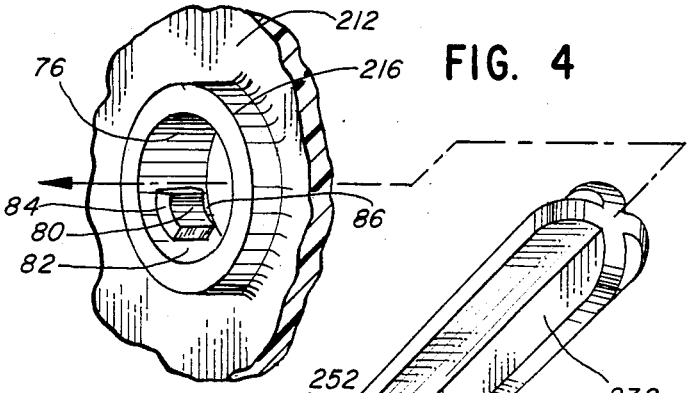
FIG. 4
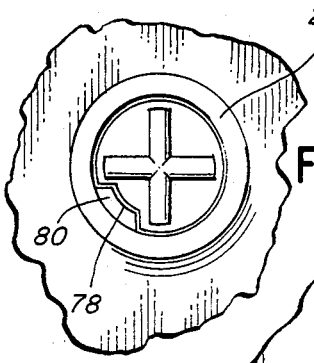
FIG. 5
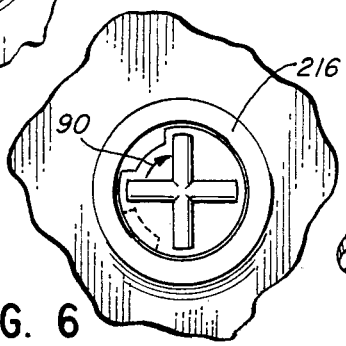
FIG. 6
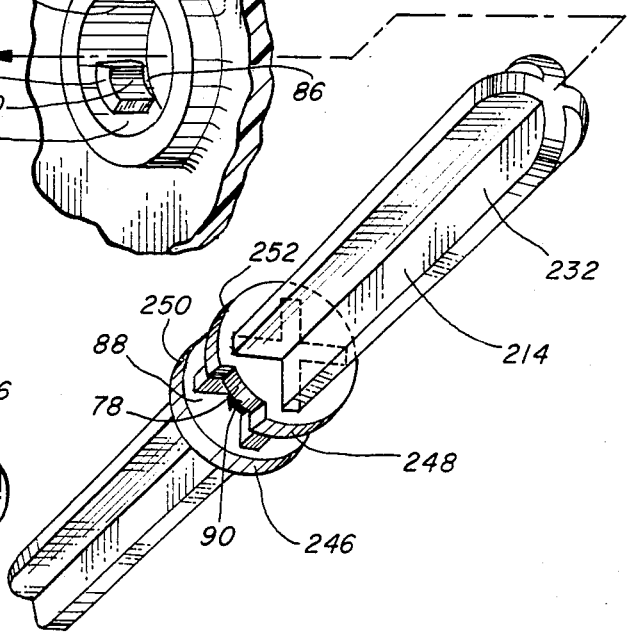

PIZZA CUTTER

BACKGROUND OF THE INVENTION

1. Field of the Invention

This invention relates to cutters with a rotary cutting wheel and commonly used on pizzas and, more particularly, to a cutter with a separable cutting sheel and operating handle.

2. Background Art

Cutting utensils having a rotary cutting wheel are known in the art. In one prior art structure, an elongate handle is extended through a hub on the wheel in alignment with the rotational axis of the wheel and is used to operate the cutting utensil. A user grasps the handle, which extends on both sides of the wheel, in the manner that a rolling pin is held, and presses the peripheral cutting edge on the wheel against the material to be cut. As the wheel is rolled under pressure, the material is severed in the path traced by the wheel edge.

An exemplary structure is shown in U.S. Pat. No. 1,200,284, to Wheaton. In Wheaton, a plurality of cutting wheels are carried on an elongate handle. The most notable drawback with the Wheaton structure is that removal of the cutting wheels from the handles and replacement of the wheels thereon cannot be readily accomplished. This type of cutting utensil is by its nature very difficult to package given the substantial length of the handle and the substantial diameter of the cutting wheel.

Another problem with conventional type wheel cutters is that the wheels are often mounted so as to be unstable under the pressure applied during cutting. Designers contend with the competing objectives of allowing free rotation of and giving suitable support for the cutting wheel.

In U.S. Pat. No. 2,089,881, to Dohring, a cutting wheel has an associated hub which has a cylindrical portion that closely surrounds a shaft and rotates relative thereto. The substantial contact area between the hub and shaft accounts for the development of large friction forces that inhibit free rotation of the wheels.

Alternatively, if the supporting contact area between the wheel and shaft is as in U.S. Pat. No. 3,346,956, to Wezel et al, the wheels, if not otherwise supported, tend to wobble as the cutting utensil is operated.

SUMMARY OF THE INVENTION

The present invention is specifically directed to overcoming the above enumerated problems in a novel and simple manner.

According to the invention, a pizza cutting device is provided comprising an elongate handle, a cutting wheel with a peripheral cutting edge and a hub having a bore with a central axis and structure for removably assembling the handle with the cutting wheel so that the cutting wheel is guidingly rotatable relative to the handle about the hub central axis.

With the cutting device disassembled, it is capable of being conveniently and compactly stored. Assembly is facilitated by, in one embodiment, providing a snap-fit connection between the hub of the cutting wheel and the handle. In another embodiment a key element and cooperating opening are provided on the handle and wheel so that assembly involves merely aligning the key element with the opening, shifting the handle axially in the hub bore and effecting a relative rotation between the wheel and handle to misalign the key element and opening.

Another objective of the invention is to positively guide rotation of the wheel relative to the handle as the cutter is used and to afford an overall stable structure. To accomplish this end, the handle has associated therewith first and second bearings with annular surfaces spaced axially with respect to the hub central axis. The annular bearing surfaces cooperate with an inside surface of the hub bounding the bore, smoothly guide rotation of the wheel and give stability to the device in operation.

The connection between the hub and wheel makes the device suitable for two handed operation. In a preferred form, the handle protrudes axially with respect to the hub central axis from both sides of the wheel. A user can simultaneously grasp both handle parts, as one would a rolling pin, press down on the device and roll the wheel over the pizza, or the like, to thereby sever the pizza in the path traced by the cutting edge. The dual bearing arrangement easily withstands anticipated forces applied during use.

BRIEF DESCRIPTION OF THE DRAWINGS

FIG. 1 is a perspective view of a preferred form of the pizza cutting device with an operating handle thereon appropriately grasped by a user;

FIG. 2 is a side elevation view of the pizza cutting device of FIG. 1;

FIG. 3 is a sectional view of the pizza cutting device along line 3—3 of FIG. 1;

FIG. 4 is a fragmentary, perspective view of an alternative structure for connecting between the operating handle and a cutting wheel to that shown in FIGS. 1–3;

FIG. 5 is a fragmentary, side elevation view of the cutting wheel and handle relatively positioned for assembly and disassembly thereof; and FIG. 6 is a view similar to that in FIG. 5 with the cutting wheel and operating handle relatively position so as to be locked in assembled relationship.

DETAILED DESCRIPTION OF THE DRAWINGS

One preferred form of pizza cutting device according to the present invention is shown in FIGS. 1–3 at 10. The device 10 comprises generally a cutting wheel 12 and an associated operating handle 14. Both the wheel 12 and handle 14 are preferably molded from a hard plastic material.

The wheel 12 comprises a central hub 16 and a disk-shaped body 18 having oppositely facing, beveled surfaces 20, 22 converging at a sharpened, peripheral cutting edge 24. The cutting edge 24 has serrations 26 thereon to enhance the cutting ability of the wheel 12 and a diameter on the order of 5 inches so that one rotation of the wheel will cut a 15 inch pizza in half.

The elongate handle 14 is directed through a bore 28 in the hub 16 and its length aligns with the central rotational axis of the wheel. The connection between the hub and handle, which is described in detail below, allows free relative rotation between the handle and the wheel.

The device is operated as shown in FIG. 1. The handle 14 projects an equal distance from both sides of the wheel and the projecting parts 30, 32 are separately grasped by a user as one would grasp a conventional rolling pin. The wheel is placed against a pizza, or whatever else is intended to be cut, and downward pressure on the wheel is applied through the handles so that the cutting edge 24 penetrates the pizza, and while keeping downward pressure applied on the wheel, the user rolls the wheel and in so doing severs the pizza in the path traced by the cutting edge 24. Because the handle is grasped on both sides, the device 10 can be positively controlled and a substantial pressure can be put on the wheel to easily sever even very thick material. Further, the path of the wheel can be positively controlled. On the other hand, the prior art devices having a single long handle extending transversely to the rotational axis of the wheel are inherently unstable in use and the cutting path cannot be easily controlled, particularly when a substantial downward force is applied on the wheel through the handle.

The invention is principally concerned with the connection between the handle 14 and the cutting wheel 12 and, particularly, the hub 16 thereon. The hub is concentric with the annular cutting edge 24. The inside surface 34 of the hub bounding the bore 28 defines axially spaced, annular seats 36, 38 and therebetween an annular bead 40. The bead has a ramp surface 42 which converges from right to left in FIG. 3. The ramp surface 42 converges to a minimum diameter edge 44 and diverges from the edge 44 towards the seat 38.

The handle 14 has two axially spaced, disk-shaped bearings 46, 48 between the projecting parts 30, 32. The bearings 46, 48 have bearing surfaces 50, 52, which closely abut the annular seats 36, 38 respectively and guide relative rotation between the wheel and handle.

To assemble the handle to the wheel, the projecting part 32 is introduced through the bore opening at the right hand side of the hub in FIG. 3. The bearing surfaces 50, 52 are substantially equal in diameter so that the bearing 48 passes smoothly past the seat 36 as the handle is introduced. Upon encountering the bead, the bearing 48 and bead bind. Both the bearing and bead progressively deform as the handle moves further towards the left and upon the bearing 48 clearing the point 44, both the bead and bearing begin to assume their undeformed state. The surface 54 of the bead between the point 44 and seal 38 guides the bearing 48 into the seat 38. The handle tends to draw itself into assembled relationship in FIG. 3 upon the bearing 48 clearing the bead 40 and expanding against the surface 54.

The bearing 48 is locked between the corner 56 at the juncture of the surface 54 and seat 38 and a wall 58 defined by a stop element 60. The stop element 60 comprises a radially inwardly projecting portion on the hub and has a restricted opening 62 of slightly greater diameter than the handle parts 30, 32. With the bearing 48 realizing its assembled position in the seat 38, the bearing 46 simultaneously moves into the seat 36. The bearing 46 is dimensioned so that the axially facing surface 64 thereon is flush with the right edge 66 of the hub in FIG. 3.

A handle portion 68, interconnecting the bearings 46, 48, comprises four radially projecting sections 70 arranged in the configuration of a cross. Each section has an outer edge 72 extending a radial distance slightly less than the radial extent of the bearing surfaces 50, 52 so that the handle portion 68 does not interfere with the bead as the device is operated.

It can be seen that the bearing 48 is held captive axially between the bead 40 and stop element 60. The spaced bearings 46, 48 cooperatively guide the relative rotation of the handle and wheel and affored substantial stability to the device by reason of their spaced location, yet do not develop friction that would appreciably inhibit rotation of the wheel relative to the handle.

To disassemble the handle and wheel, the handle is drawn axially to the right in FIG. 3 causing the bearing 48 to move up the surface 54 and thereby deform the bead and bearing 48 sufficiently to allow passage of the bearing over the bead. The relative dimensions of the bead and bearing are chosen so the handle and hub can be snap-fit together and snapped apart under a force that can be easily applied by a user. A sufficient force should be required so that the handle and wheel are not inadvertently separated during use.

To facilitate grasping of the handle, the projecting parts 30, 32 of the handle are each formed by four sections 74 arranged at right angles to each other and make a cross when viewed from an end thereof as seen clearly in FIG. 2. The user hand tends to deform into the space between adjacent sections 74 and this minimizes any slippage of the hand over the handle as the device is operated.

An alternative connection between a corresponding wheel 212 and handle 214 is shown in FIGS. 4–6. The hub 216 has a central bore 76 of substantially uniform diameter and makes close mating relationship with annular surfaces 250, 252 on corresponding bearings 246, 248 respectively. The difference in the handle in FIG. 4 from that in FIGS. 1–3 is that the bearing 248 has an opening 78 which accommodates a key element 80 on the inside surface 82 bounding the bore 76. The key element has a width axially relative to the hub bore that is substantially equal to the spacing between the bearings 246, 248. As a result, in assembled relationship, the axially oppositely facing surfaces 84, 86 guide facing surfaces 88, 90 on the bearings 246, 248.

To assemble the handle, the projecting handle portion 232 is directed from right to left in FIG. 4 through the hub bore 76. The handle and wheel are relatively rotated so that the key element 80 aligns with the opening 78. It should be understood that the key element can take any configuration so long as the opening 78 accepts the key element upon insertion of the handle into the hub bore. As the projecting part is directed into the hub bore, the key element slides past the bearing 248 through the opening 78. Insertion of the handle will be arrested upon the surface 88 of bearing 246 encountering the key element 80. As shown in FIG. 5, relative rotation between the handle and wheel, as for example in the direction of arrow 90, misaligns the key element and opening 78. The handle and wheel are inseparable in other than the FIG. 5 position.

All the advantages of the prior structure are realized with that shown in FIGS. 4–6. The dual, spaced bearings afford stability, yet do not substantially resist relative rotation between the wheel and handle.

It should be understood that the foregoing detailed description was made for purposes of demonstrating the inventive structure and its operation, with no unnecessary limitations to be understood therefrom.

We claim:

1. A device for cutting pizza comprising:

an elongate handle with a bearing having an outer surface with a first diameter;

a cutting wheel having a peripheral cutting edge and a hub having a bore with a central axis, said hub having an annular bearing seating surface with a diameter greater than the first diameter, a stop element through which said bore extends to define an opening with a diameter less than the first diameter, and an annular bead coaxial with the bore and having a portion with a diameter less than the first diameter; and means permitting passage of the bearing past the annular bead for removably snap-fitting the elongate handle and hub together into assembled relationship, wherein the bearing is held removably captive between the bead and stop element in axial alignment with the bearing seating surface, upon the handle being moved within the bore along the hub axis, said elongate handle and hub being relatively rotatable about the hub central axis with the bearing on the elongate handle guided by the bearing seating surface on the hub in said assembled relationship, whereby a user can grasp the elongate handle, press the cutting edge against the pizza and move the cutting wheel so that a pizza is severd along a path traced by the cutting edge.

2. A device for cutting pizza comprising:

an elongate handle;

a cutting wheel having a peripheral cutting edge and a hub having a bore with a central axis; and means for removably snap-fitting the elongate handle and hub together into assembled relationship upon the handle being moved within the bore along the hub axis so that said elongate handle and hub arae relatively rotatable about the hub central axis with the elongate handle and hub in said assembled relationship, wherein the hub has an inside surface bounding said bore, the inside surface has an annular bead with an edge having a first inside diameter, the cutting wheel has a bearing with a surface having a second outside diameter slightly greater than the first diameter, at least one of the annular bead and bearing surface is deformable and a stop element is provided on the wheel and is spaced axially of the hub from the annular bead whereupon movement of the handle within the bore in a first direction brings the bearing surface against the annular bead and upon further axial movement of the handle within the bore in said first direction one of the bead and bearing deforms to allow passage of the bearing surface axially over the bead so that the bearing surface is held captively between the bead and the stop element and acts against the inside hub surface to guide relative rotation of the cutting wheel and handle, whereby a user can grasp the elongate handle, press the cutting edge against the pizza and move the cutting wheel so that a pizza is severed along a path traced by the cutting edge.

3. The pizza cutting device according to claim 1 wherein said elongate handle and cutting wheel are made from plastic.

4. A device for cutting pizza comprising:

an elongate handle;

a cutting wheel having a peripheral cutting edge and a hub having a bore with a central axis; and means for removably snap-fitting the elongate handle and hub together into assembled relationship upon the handle being mvoed within the bore along the hub axis so that said elongate handle and hub are relatively rotatable about the hub central axis with the elongate handle and hub in said assembled relationship, wherein said handle has first and second bearings spaced lengthwise thereof, each said bearing has an annular bearing surface with an outer diameter, the hub has an inside surface bounding the hub bore and the inside surface bounding the hub has an annular bead having an edge with an inside diameter that is slightly less than the outer diameter of the annular bearing surface on the first bearing, at least one of the annular bead and first bearing is deformable so that upon the handle being moved within the hub bore in a first direction the first bearing encounters the annular bead and upon further axial movement of the handle within the bore at least one of the bead and first bearing deforms to allow passage of the first bearing over the bead in the first direction so that the bead resided between the first and second bearings and the annular bearing surfaces on each of the first and second bearings act against the inside hub surface to guide relative rotation of the cutting wheel and handle, whereby a user can grasp the elongate handle, press the cutting edge against the pizza and move the cutting wheel so that a pizza is severed along a path traced by the cutting edge.

5. The pizza cutting device according to claim 2 wherein the stop element comprises a wall on the hub, said wall having an opening for accepting the handle and being sufficiently restricted to prevent passage through the opening of the bearing.

6. The pizza cutting device according to claim 2 wherein the bead has an annular ramp surface that decreases in diameter in said first direction so that the one of the annular bead and bearing surface is progressively deformed as the handle is moved in the hub bore in said first direction.

7. The pizza cutting device according to claim 4 wherein the outer diameters of said bearing surfaces on the first and second bearings are substantially equal.

8. A device for cutting pizza comprising:

an elongate handle;

a cutting wheel having a peripheral cutting edge and a hub having a bore with a central axis means for guiding relative rotation between the elongate handle and cutting wheel with the handle and wheel in assembled relationship wherein the handle is extended through the hub bore into a first relative axial relationship therewith; and means for permitting relative axial movement of the elongate handle and cutting wheel into and out of said assembled relationship only with the handle and wheel in a first relative rotational relationship and for preventing the wheel and handle from moving into and out of said assembled relationship with said wheel and handle in other than said first relative rotational relationship, whereby a user can grasp the elongate handle, press the cutting edge against the pizza and move the cutting wheel so that a pizza is severed along a path traced by the cutting edge.

9. A device for cutting pizza comprising:

an elongate handle;

a cutting wheel having a peripheral cutting edge and a hub having a bore with a central axis; and means for removably attaching the handle to the wheel hub so that the length of the handle is aligned with the central hub axis with the wheel hub and handle in assembled relationship and so that the hub and handle are relatively rotatable about the hub central axis and are maintained against separation from each other in an axial direction with the hub and handle in said assembled relationship.

wherein said hub has an inside surface bounding said bore, said handle has a bearing with an annular surface, one of said hub and bearing has a key element, the other of the hub and bearing has an opening for accepting the key element and allowing passage of the handle into said hub bore in a first direction sufficiently that the assembled relationship between the wheel hub and handle can be realized with the handle and hub in a first relative rotational position about the bore central axis, said annular bearing surface acts against said inside hub surface to guide relative rotation between the wheel and handle, said key element and opening being misaligned with the handle and hub relatively situated in other than said first relative rotational position so as to thereby prevent removal of the handle from the wheel hub and assembly of the handle and wheel hub with the wheel hub and handle in other than said first relative rotational position and means are provided to prevent shifting of the handle in said first direction beyond the relative position of the handle and wheel hub with the wheel hub and handle in said assembled relationship, whereby a user can grasp the elongate handle, press the cutting edge against the pizza and move the cutting wheel so that a pizza is severed along a path traced by the cutting edge.

10. The pizza cutting device according to claim 8 wherein the handle and cutting wheel are made from plastic.

11. The pizza cutting device according to claim 9 wherein said handle has first and second bearings, the opening is in the first bearing, the means for preventing shifting is the second bearing which abuts the key element with the hub and handle in said assembled relationship, said second bearing has an annualr surface that is spaced axially of the hub bore axis from the annular surface on the first bearing and the annular surfaces on the first and second bearings simultaneously act against the hub inside surface to guide relative rotation between the handle and cutting wheel.

* * * * *